US006427851B1

(12) United States Patent
Chang

(10) Patent No.: US 6,427,851 B1
(45) Date of Patent: Aug. 6, 2002

(54) RACK HAVING STACKABLE CONFIGURATION

(76) Inventor: Chun Yuan Chang, 5F-1, No. 81, Sec. 2, Chern Der Road, Taipei (TW)

( * ) Notice: Subject to any disclaimer, the term of this patent is extended or adjusted under 35 U.S.C. 154(b) by 0 days.

(21) Appl. No.: 09/751,964

(22) Filed: Jan. 2, 2001

(51) Int. Cl.[7] ..... A47F 5/00
(52) U.S. Cl. ..... 211/42; 211/50; D19/90
(58) Field of Search ..... 211/42, 50; D6/475; D19/90, 91

(56) References Cited

U.S. PATENT DOCUMENTS

D104,956 S * 6/1937 Baker
3,592,344 A * 7/1971 Schade ..... 211/42
D253,444 S * 11/1979 Mathus et al.
D299,360 S * 1/1989 Klodt ..... D19/90
D299,389 S * 1/1989 Klodt ..... D6/475 X
4,909,398 A * 3/1990 Santucci ..... 211/50
D309,066 S * 7/1990 Foran et al. ..... D6/466
D328,761 S * 8/1992 Evenson ..... D19/90
D390,606 S * 2/1998 Cheris et al. ..... D19/90
D446,967 S * 8/2001 Stravitz ..... D19/90 X

* cited by examiner

*Primary Examiner*—Robert W Gibson, Jr.
(74) *Attorney, Agent, or Firm*—Charles E. Baxley

(57) ABSTRACT

A rack includes a front and lower horizontal board, and a rear and upper vertical panel, and two or more plates coupled between the horizontal board and the vertical panel. The books, the documents or the files received in the rack may be engaged with the horizontal board to force and support the rack in the erect working position. Two or more racks may be stacked together to form a compact packing or packaging configuration for storing and transportation purposes. A stand is engaged with the rack for supporting the rack in the erect working position.

4 Claims, 6 Drawing Sheets

RACK HAVING STACKABLE CONFIGURATION

BACKGROUND OF THE INVENTION

1. Field of the Invention

The present invention relates to a rack, and more particularly to a rack having a configuration for allowing a number of racks to be stacked together.

2. Description of the Prior Art

Various kinds of typical racks have been widely developed and used. U.S. Pat. No. 2,691,447 to Schiffer discloses one of the typical racks. The typical racks occupy a large volume and may not be stacked together for reducing the packing size, such that the racks are not good for transportation and storing purposes.

The present invention has arisen to mitigate and/or obviate the afore-described disadvantages of the conventional racks.

SUMMARY OF THE INVENTION

The primary objective of the present invention is to provide a rack including a configuration for allowing a number of racks to be stacked together and for facilitating the storing and transportation of the racks.

In accordance with one aspect of the invention, there is provided a rack comprising a body including a front and lower portion having a horizontal board provided therein, and including a rear and upper portion having a vertical panel provided therein, and including at least two plates coupled between the horizontal board and the vertical panel of the body. The books, the files or the documents received in the body may be engaged with the horizontal board and may thus force and support the body in the erect working position. Two or more racks may be stacked together to form a compact packing or packaging configuration that is good for storing and transportation purposes.

The body includes an upper and front portion having a cut-off opening formed therein, and includes a rear and lower portion having a cut-off opening formed therein for further reducing the packing size of the racks.

A stand is further provided and disposed in the rear and lower cut-off opening of the body and engaged with the body for supporting the body in an erect working position.

The body includes an intermediate plate, the stand is secured to the intermediate plate. The stand is U-shaped having two ends engaged in the intermediate plate. The plates each includes a horizontal rear and upper portion and an inclined front portion. It is preferable that the intermediate plate includes two hubs for receiving or for engaging with the ends of the stand, with such as a force-fitted engagement, and for supporting the rack in the erect working position.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
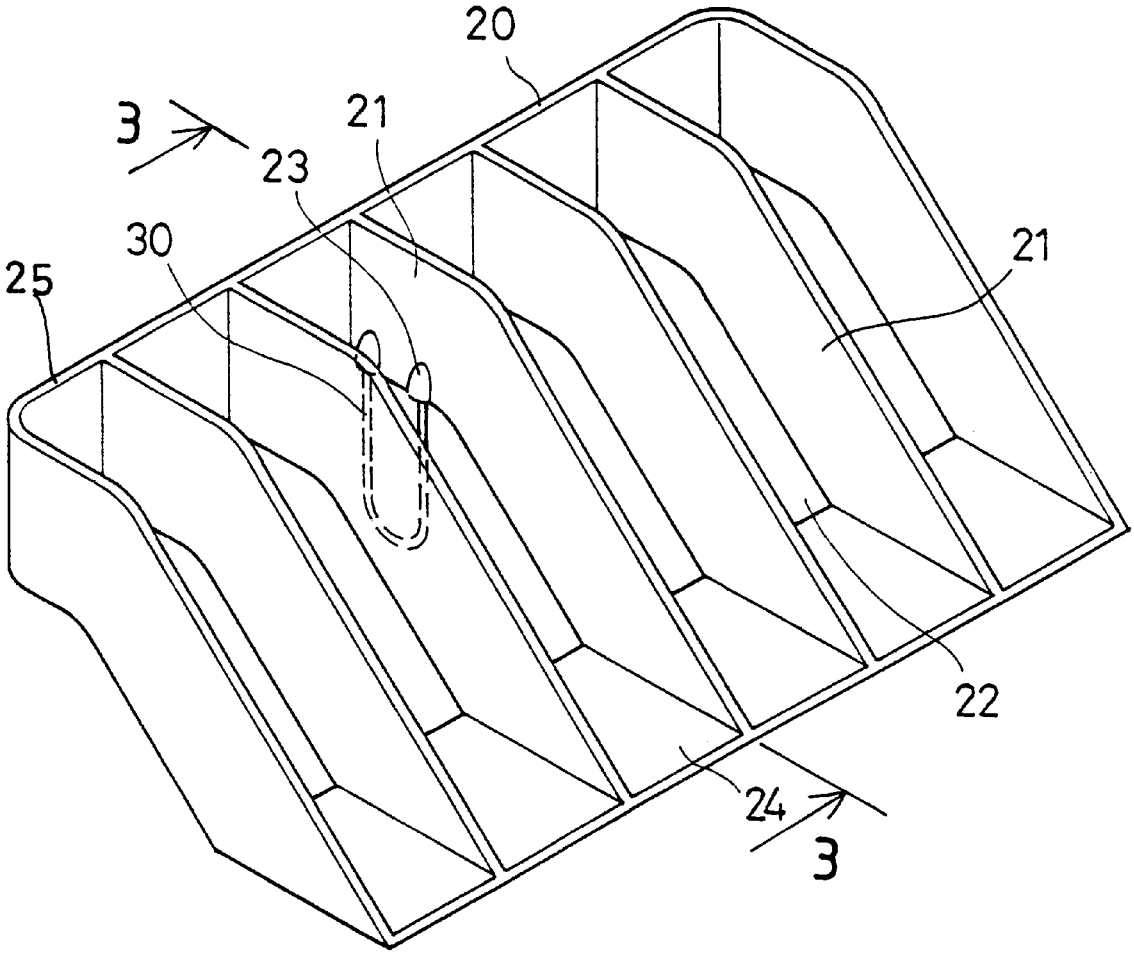
FIG. 1 is a perspective view of a rack in accordance with the present invention.
Figure 2:
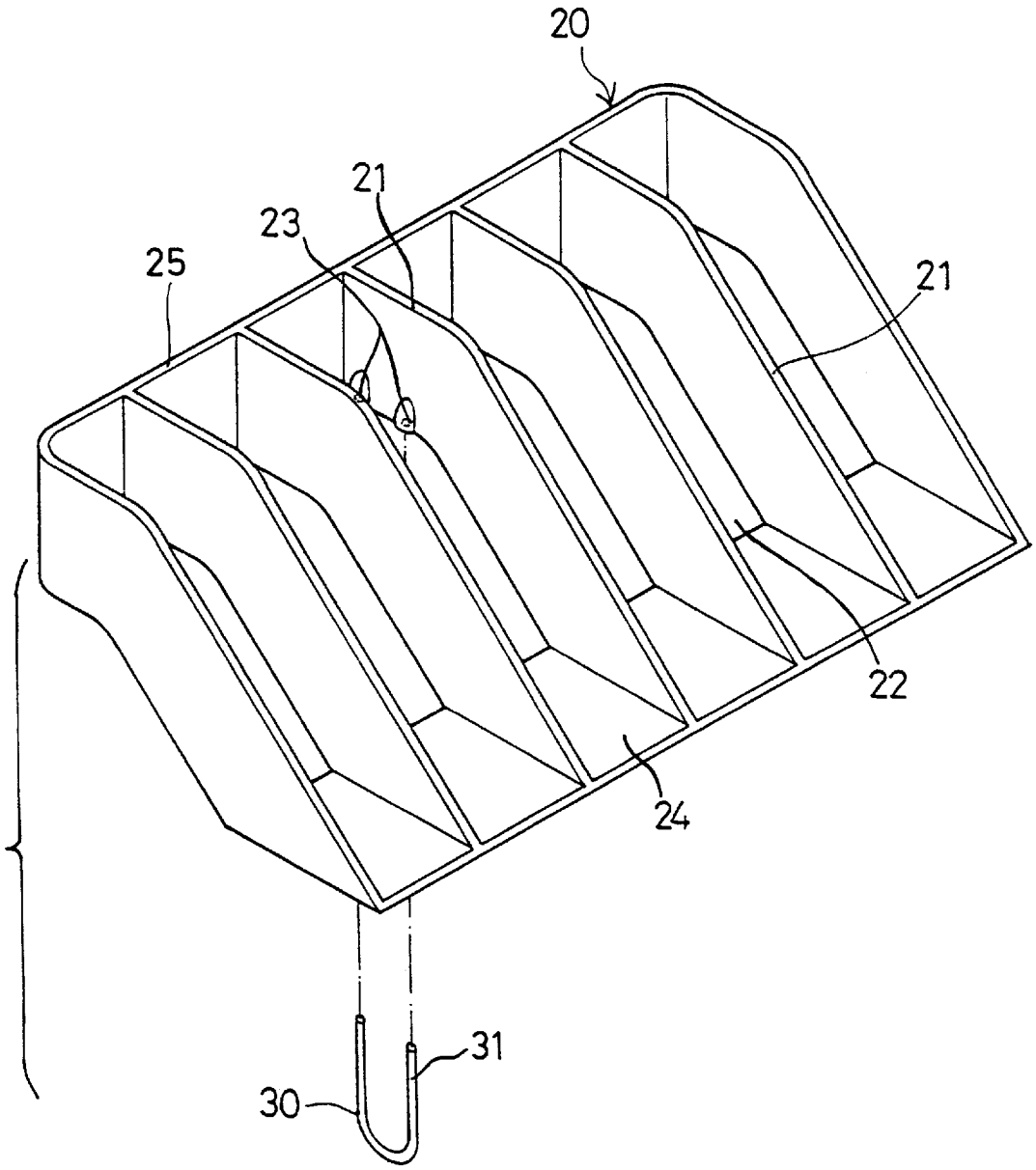
FIG. 2 is an exploded view of the rack.
Figure 3:
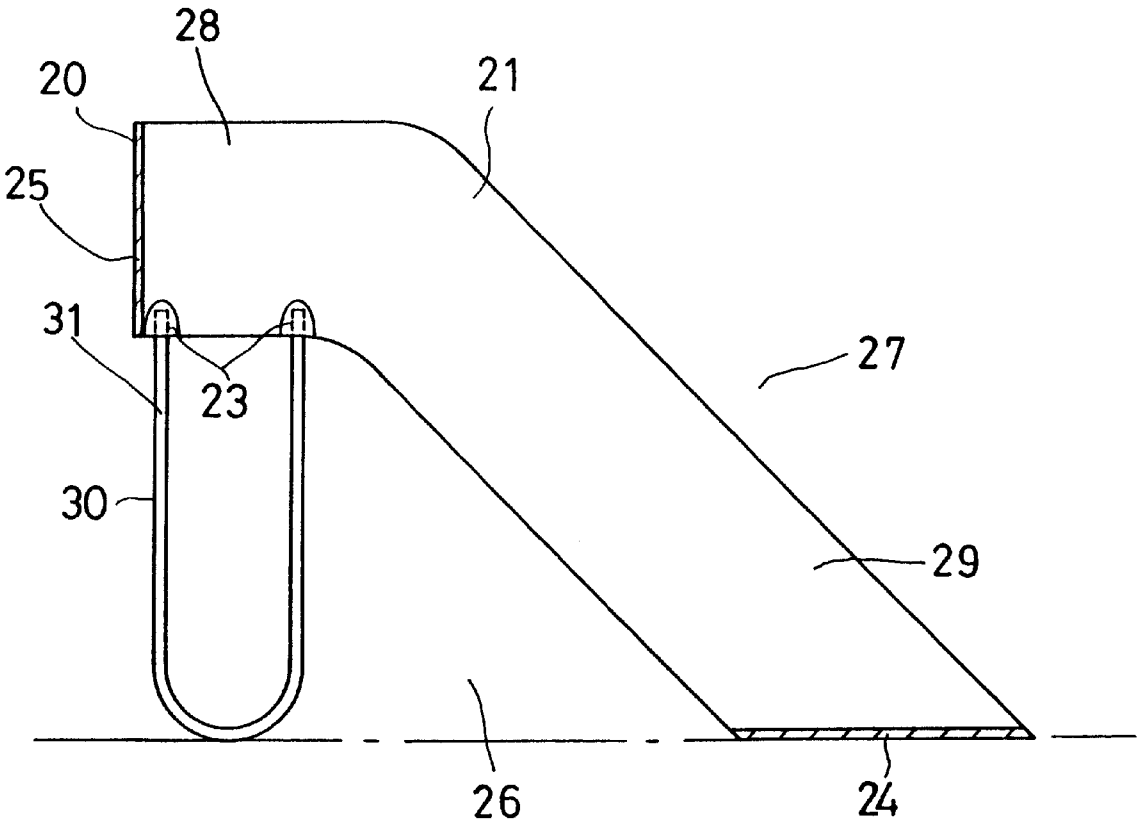
FIG. 3 is a cross sectional view taken along lines 3—3 of FIG. 1.

Referring to the drawings, and initially to FIGS. 1–3, a rack in accordance with the present invention comprises a body 20 including a horizontal board 24 provided on the front and lower portion thereof, and including a vertical panel 25 provided on the rear and upper portion thereof, and including a number of vertical plates 21 secured or coupled between the horizontal board 24 and the vertical panel 25 for forming or defining a number of spaces 22 between the vertical plates 21 and for receiving books, documents, files etc. therein. The plates 21 each includes a horizontal rear and upper portion 28 and an inclined front portion 29 (FIGS. 3, 4).

Figure 4:
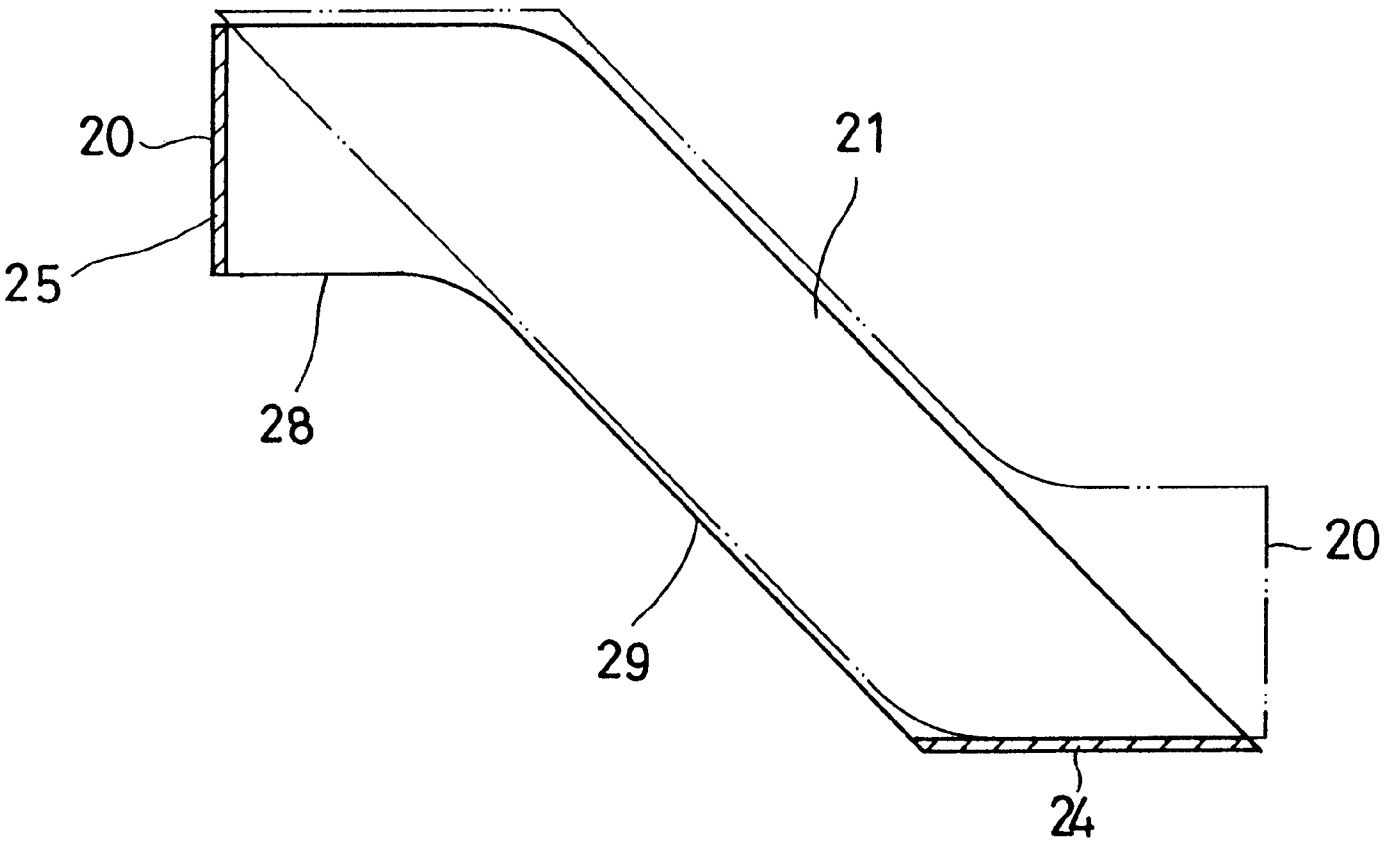
FIG. 4 is a cross sectional view similar to FIG. 4, illustrating the stacking of the racks.

The body 20 includes a notch or a cut-off opening 26 formed in the rear and lower portion thereof, and includes another notch or another cut-off opening 27 formed in the front and upper portion thereof, and defined by the horizontal rear and upper portion 28 and an inclined front portion 29 of the plates 21 (FIGS. 3, 4). A stand 30 is attached to the rear portion of the body 20, and attached to the bottom of the horizontal rear and upper portion 28 of the intermediate plate 21 for supporting the body 20 in the erect working position as shown in FIGS. 1, 3. For example, the intermediate plate 21 includes two hubs 23 provided in the bottom portion thereof. The stand 30 includes a U-shaped configuration having two ends 31 engaged into and secured to the hubs 23 of the plate 21, with such as a force-fitted engagement, for supporting the body 20 in the erect working position.

Figure 5:
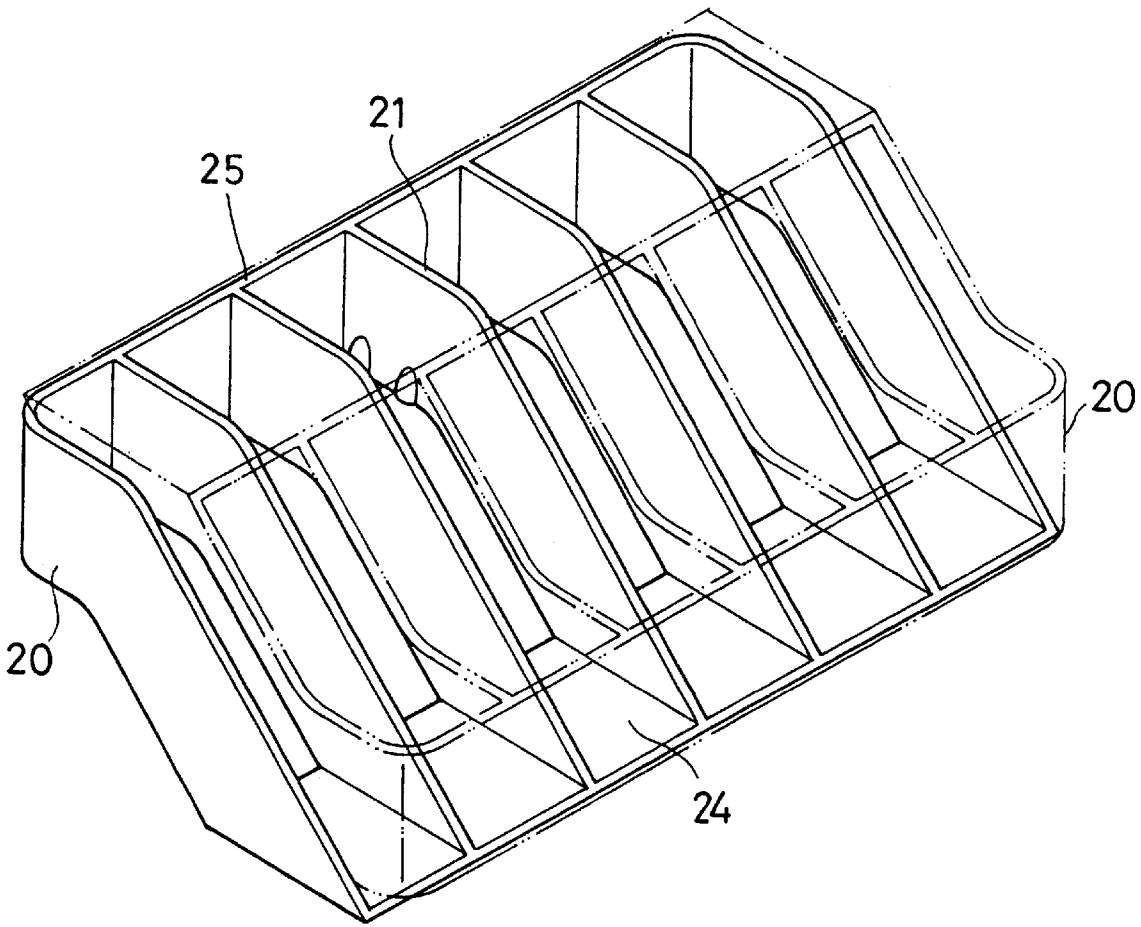
FIG. 5 is a perspective view illustrating the stacking of the racks.
Figure 6:
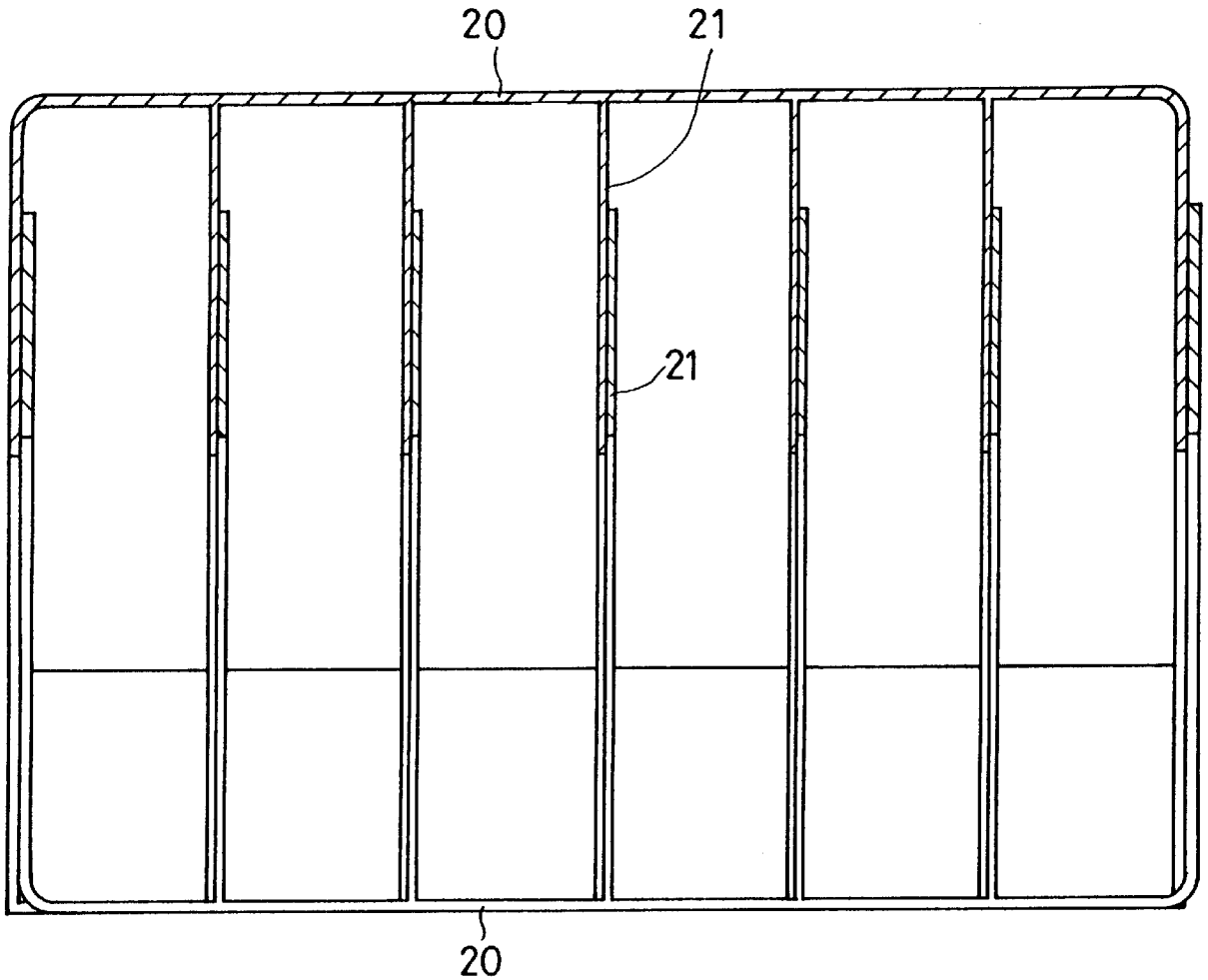
FIG. 6 is a top plane view illustrating the stacking of the racks.

Referring next to FIGS. 4–6, the body 20 includes an open front and upper portion for allowing two racks 20 to be stacked together and for greatly reducing the packing or storing size of the rack.

In operation, it is to be noted that the books, the files or the documents received in the body 20 may be engaged with the horizontal board 24 and may thus force and support the body 20 in the erect working position without the stand 30. The body 20 may include only the two side plates 21 without any intermediate plates 21.

Accordingly, the rack in accordance with the present invention includes a configuration for allowing a number of racks to be stacked together and for facilitating the storing and transportation of the racks.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rack comprising:

a rack body including a front and lower portion having a horizontal board provided therein, and including a rear and upper portion having a vertical panel provided therein. and including at least two plates coupled between said horizontal board and said vertical panel of said rack body, said rack body including an upper and front portion having a first notch formed therein, and including a rear and lower portion having a second notch formed therein, a stand disposed in said second notch of said rack body and detachably secured to said rack body for supporting said rack body in an erect working position.

2. The rack according to claim 1, wherein said rack body includes an intermediate plate. said stand is secured to said intermediate plate.

3. The rack according to claim 2, wherein said stand is U-shaped having two ends engaged in said intermediate plate.

4. The rack according to claim 3, wherein said intermediate plate includes two hubs provided therein for receiving said ends of said stand.

* * * * *